US008936483B2

(12) United States Patent
Saunders et al.

(10) Patent No.: US 8,936,483 B2
(45) Date of Patent: Jan. 20, 2015

(54) CONNECTOR HAVING A PORTION PROTRUDING FROM AN OVER-MOLD PORTION RECEIVABLE IN CONNECTORS OF MULTIPLE FORM FACTORS

(71) Applicant: Intel Corporation, Santa Clara, CA (US)

(72) Inventors: Bradley Saunders, Portland, OR (US); Robert Dunstan, Forest Grove, OR (US)

(73) Assignee: Intel Corporation, Santa Clara, CA (US)

( * ) Notice: Subject to any disclaimer, the term of this patent is extended or adjusted under 35 U.S.C. 154(b) by 33 days.

(21) Appl. No.: 13/680,766

(22) Filed: Nov. 19, 2012

(65) Prior Publication Data

US 2014/0141639 A1 May 22, 2014

(51) Int. Cl.

*H01R 13/627* (2006.01)
*H01R 27/00* (2006.01)
*H01R 13/62* (2006.01)

(52) U.S. Cl.

CPC ..... *H01R 13/627* (2013.01); *H01R 27/00* (2013.01); *H01R 13/6205* (2013.01); *H01R 13/6276* (2013.01); *H01R 2201/06* (2013.01)

USPC ..... 439/351

(58) Field of Classification Search

USPC ..... 439/350–358

See application file for complete search history.

(56) References Cited

U.S. PATENT DOCUMENTS

| | | | | |
|---|---|---|---|---|
| 5,729,478 | A * | 3/1998 | Ma et al. | 361/679.41 |
| 6,431,919 | B1 * | 8/2002 | Wang et al. | 439/680 |
| 6,558,201 | B1 * | 5/2003 | Begley et al. | 439/638 |
| 7,331,793 | B2 * | 2/2008 | Hernandez et al. | 439/38 |
| 8,075,199 | B2 * | 12/2011 | Losio et al. | 385/92 |
| 8,564,291 | B2 * | 10/2013 | Nelson et al. | 324/309 |
| 8,641,429 | B2 * | 2/2014 | Fish et al. | 439/76.1 |
| 2011/0159706 | A1 * | 6/2011 | Wu | 439/39 |
| 2012/0058668 | A1 * | 3/2012 | De Bruijn et al. | 439/399 |

* cited by examiner

*Primary Examiner* — Chandrika Prasad

(74) *Attorney, Agent, or Firm* — International IP Law Group, P.L.LC.

(57) ABSTRACT

A method of receiving a connector at a receptacle is described. The method may include receiving a portion of an over-mold portion into a recess of a platform housing of a platform when the recess is available. The method may also include receiving a connector, relatively smaller than the over-mold portion, into a receptacle of the platform whether or not the recess is available.

40 Claims, 4 Drawing Sheets

100

200

100

200

300

400

CONNECTOR HAVING A PORTION PROTRUDING FROM AN OVER-MOLD PORTION RECEIVABLE IN CONNECTORS OF MULTIPLE FORM FACTORS

TECHNICAL FIELD

This disclosure relates generally to Input/Output (I/O) connectors and receptacles. Specifically, the present disclosure describes a multi-platform I/O connector.

BACKGROUND ART

Some input-output (I/O) technologies such as universal serial bus (USB), high definition multimedia interface (HDMI), DisplayPort, and the like, have multiple connectors defined so as to have appropriately sized connector plugs and receptacles for different sized platforms. For example, all of these technologies have standard-sized solutions for larger platforms such as desktop computers, personal computers, laptop computers, printers, and the like. Some of these technologies have smaller solutions for smaller devices such as smartphones, tablets, and the like.

BRIEF DESCRIPTION OF THE DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DESCRIPTION OF THE EMBODIMENTS

The present disclosure relates generally to techniques for providing a multi-platform I/O connector assembly that includes a plug that is suitable for use with any size platform. The multi-platform connector assembly, also referred to herein simply as the connector assembly, includes plug and a receptacle. The plug includes a connector portion and an over-mold portion. The over-mold portion may be received at the relatively larger platforms having a recess. Other relatively smaller platforms may receive only the connector portion without receiving the over-mold portion. By providing a connector and an over-mold portion, the physical connection may be more robust (e.g., improved retention of the connector, tolerance to stresses from lateral forces, etc.) when the recess is available on the relatively larger platforms. Additionally, the connector may also be received at a receptacle of a relatively smaller platform even when the receptacle recess is not available. In other words, the present techniques relate to a standardized connector and aver-mold portion that may be received by two standardized receptacles, one appropriate for relatively larger platforms and one appropriate for relatively smaller platforms with respect to the relatively larger platforms. In the description herein, a connector assembly refers to a connector, an over-mold portion, and a receptacle.

Figure 1:
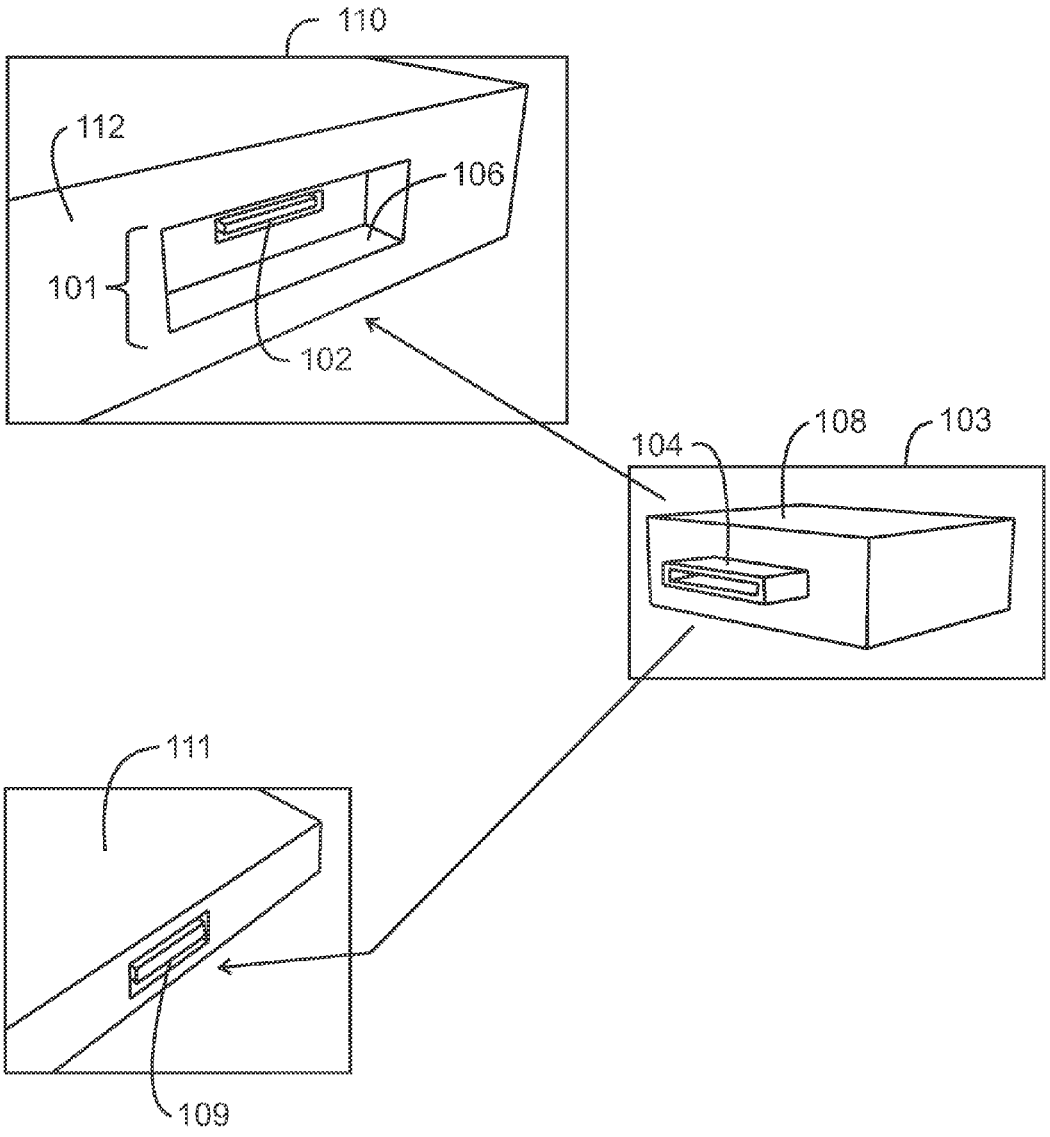
FIG. 1 is a block diagram of a connector assembly in accordance with embodiments.

FIG. 1 is a block diagram of a connector assembly 100 in accordance with embodiments. The connector assembly 100 includes an I/O receptacle 101 configured to receive a plug 103. The plug 103 includes an aver-mold portion 108 and a first connector portion 104 protruding from the over-mold portion 108. The first connector portion 104 may be selectively coupled to one of a second connector 109 of a small form factor device 111, and a third connector 102 of a large form factor device 110. When coupled to the third connector 102, the over-mold portion 108 is inserted into a recess 106 of the large form factor device 110 which surrounds the third connector 102. The receptacle 101 of the large form factor device 110 may have a platform housing 112. The recess being within the platform housing 110.

In some embodiments, the large form factor device 110 may be a relatively larger platform, as compared to the small form factor device 111, such as a personal computing device, a desktop computer, a laptop computer, and the like. The small form factor device 111 may be a relatively smaller platform, as compared the large form factor device 110, such as a smartphone, a mobile phone, a tablet computer, and the like. When inserted into the larger form factor device 110, the connector of the receptacle may be a first connector 102, and the protruding connector 104 may be a second connector protruding from the over-mold portion 108 of the plug 103. The first connector 102 may be disposed within the recess 106, and the first connector 102 may be configured to receive the second connector 104.

The first connector portion 104 of the plug 103 may be any suitable connector type such as a universal serial bus (USB), a DisplayPort bus, an HDMI interface, and the like. The recess 106 may enable the first connector portion 104 and the over-mold portion 108 may be received at the platform housing 112. Therefore, the over-mold portion 108 may facilitate alignment of the first connector portion 104 with the receptacle 102. The over-mold portion 108 may also provide lateral and vertical retention support to the first connector portion 104 when a force is received at the over-mold portion 108. The force may be due to a force applied to a cable (not shown) coupled to the over-mold portion 108. The force applied to the cable may be due to the weight of the cable, a strain placed on the cable due to a particular arrangement of the cable in the connector assembly 100, and the like.

As can be appreciated from FIG. 1 and the accompanying description, the plug 103 is configured to be suitable for multiple platform sizes. For example, the plug 103 is small enough to be used in small form factor devices 111 such as smart phones, while still providing the physical support and ease of insertion of a larger plug when coupled to larger form factor devices 110 such as desktops and laptops.

Figure 2:
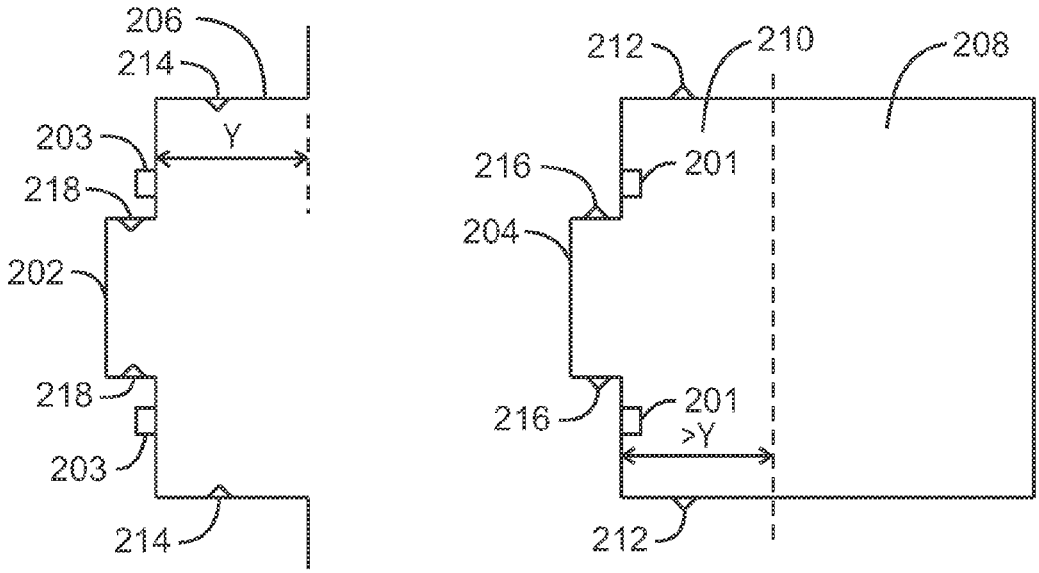
FIG. 2 is a block diagram of a top view of a connector assembly including a second connector portion configured to receive a first connector portion.

FIG. 2 is a block diagram of a top view of the connector assembly 200 including a second connector portion 202 configured to receive a first connector portion 204. The connector assembly may include a recess 206 of a large form factor device to receive at least some of an over-mold portion 208. As depicted in FIG. 2, a portion 210 of the over-mold 208 may have a length equal to or greater than a distance Y, and the recess 206 may be configured to be equal to Y to enable the recess 206 to receive the portion 210 of the over-mold 208 such that second connector portion 202 is fully mated with first connector portion 204.

In some embodiments, the connector assembly 200 may include a latching mechanism 212, 214 at the over-mold portion 208 and the recess 206, respectively. The latching mechanism 212, 214 may be a mechanical latching mechanism including, but not limited to, a ball and catch mechanism, a spring latch, a protruding barb and respective recess, and the like. Alternatively or additionally, the connector assembly may include a latching mechanism 201, 203 including magnets at the over-mold portion 208 and at the recess 206. In embodiments, the connector assembly 200 may include any combination of mechanical mechanisms and magnetic latching mechanisms disposed at various locations of the connector assembly 200 without limitation. For example, the latching mechanism 201, 203 may comprise mechanical latching mechanisms. As another example, the latching mechanisms 212, 214 may include magnetic latching mechanisms.

In some embodiments, the connector assembly 200 may include a latching mechanism 216, 218 of the first connector portion 204 and the second connector portion 202, respectively. The latching mechanism 216, 218 maybe a mechanical latching mechanism including, but not limited to, a ball and catch mechanism, a spring latch, a protruding barb and respective recess, and the like.

Figure 3:
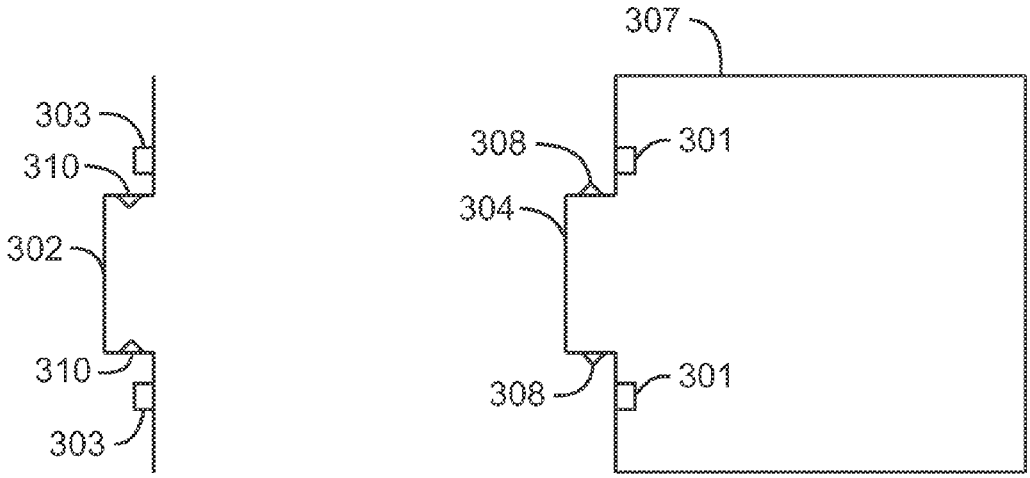
FIG. 3 is a block diagram of a top view of a connector assembly including a receptacle to receive a connector when a recess is unavailable.

FIG. 3 is a block diagram of a top view of a connector assembly 300 including a receptacle 302 to receive a connector 304 at a small form factor device. When compared to FIG. 2, the connector assembly 300 of FIG. 3 does not have a recess available, such as the recess 206 of FIG. 2. The receptacle 302 may still receive the connector 304 at the receptacle 302 even when the recess is unavailable. For example, a smaller computing device such as a tablet or a smartphone may have a smaller platform housing. Therefore, the receptacle 302 may receive the connector 304 without receiving the over-mold portion 307 within a recess. The connector 304 and over-mold portion 307 may thereby be connected to a relatively smaller computing device with a relatively smaller platform housing, or may be received by a relatively larger computing device with a relatively larger platform housing.

In some embodiments, the connector assembly 300 may include a latching mechanism 308, 310 of the connector 304 and the receptacle 302, respectively. The latching mechanism 308, 310 may be a mechanical latching mechanism including, but not limited to, a ball and catch mechanism, a spring latch, a protruding barb and respective recess, and the like at the connector 304 and at the receptacle 302. Additionally or alternatively, the latching mechanism may include magnets 301, 303 at the platform housing and an over-mold portion 307.

Figure 4:
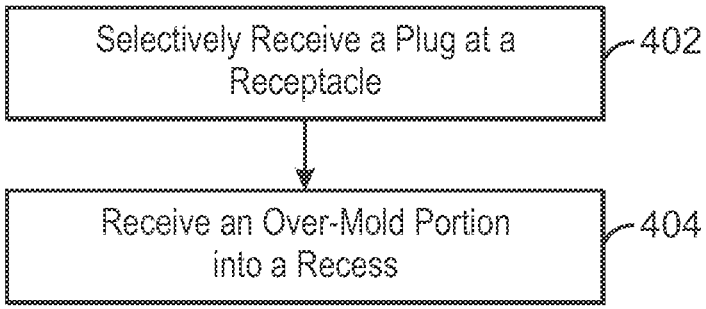
FIG. 4 is a block diagram of a method for receiving a connector at a receptacle.

FIG. 4 is a block diagram of a method 400 for receiving a connector at a receptacle. The method 400 may include selectively receiving 402 a plug comprising an over-mold portion and a first connector portion protruding from the over-mold portion at a receptacle. Selectively receiving 402 may include one of receiving the first connector portion of the plug at a second connector of a small form factor device, and receiving the first connector portion of the plug at a third connector of a large form factor-device. The method 400 may also include receiving 404 the over-mold portion into a recess of the large form factor device which surrounds the third connector. For example, a personal computing device may have a relatively larger platform housing compared to a tablet computing device. The larger platform housing may include the third connector portion. In contrast, a smaller platform, such as the tablet computing device, may include the second connector portion.

In some embodiments, the method 400 may further include latching the over-mold portion at the recess when available. Latching is carried out by a latching mechanism. In other embodiments, the latching mechanism may include magnets at the over-mold portion and at the recess. In yet other embodiments, the latching mechanism may include mechanical latching mechanisms at the over-mold portion and at the recess.

In some embodiments, the method 400 may further include via a latching mechanism at the over-mold portion of the plug and the recess, the plug to the receptacle when the first connector of the plug is selectively received at the third connector of the receptacle. In other embodiments, the latching mechanism may include magnets at the over-mold portion and at the recess. In yet other embodiments, the latching mechanism may include mechanical latching mechanisms at the first connector and at the second connector.

In some embodiments, the method 400 may also include aligning the first, connector with the third connector. The alignment is facilitated by the over-mold portion and the recess. For example, a user may be unable to have sufficient visibility when inserting the plug into the receptacle. Therefore, the over-mold portion may facilitate alignment of the first connector of the plug with the second connector of the receptacle while inserting the over-mold portion into the recess.

In some embodiments, the method 400 may also include supporting the first connector received at the third connector from a force received at the over-mold portion. The over-mold portion may facilitate the support. For example, a force may be received at the over-mold portion via a cable coupled to the over-mold portion. The over-mold portion may be supported by the recess when a portion of the over-mold portion has been received by the recess.

Some embodiments may be implemented in one or a combination of hardware, firmware, and software. Some embodiments may also be implemented as instructions stored on the tangible non-transitory machine-readable medium, which may be read and executed by a computing platform to perform the operations described. In addition, a machine-readable medium may include any mechanism for storing or transmitting information in a form readable by a machine, e.g., a computer. For example, a machine-readable medium may include read only memory (ROM); random access memory (RAM); magnetic disk storage media; optical storage media; flash memory devices; or electrical, optical, acoustical or other form of propagated signals, e.g., carrier waves, infrared signals, digital signals, or the interfaces that transmit and/or receive signals, among others.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

It is to be understood that specifics in the aforementioned examples may be used anywhere in one or more embodiments. For instance, all optional features of the computing device described above may also be implemented with respect to either of the methods or the computer-readable medium described herein. Furthermore, although flow diagrams and/or state diagrams may have been used herein to describe embodiments, the techniques are not limited to those diagrams or to corresponding descriptions herein. For example, flow need not move through each illustrated box or state or in exactly the same order as illustrated and described herein.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. A multi-platform I/O connector plug, comprising:

an over-mold portion;

a first connector portion protruding from the over-mold portion, the first connector portion to be selectively coupled to one of a second connector of a small form factor computing device having no recess to receive the over-mold portion and a third connector of a large form factor computing device having a recess to receive the over-mold portion, the recess comprising four sides to provide vertical retention and lateral retention support to a connector to be received in the recess;

wherein, when coupled to the third connector, the over-mold portion is inserted into the recess of the large form factor computing device which surrounds the third connector; and a latching mechanism at the over-mold portion.

2. The multi-platform I/O connector plug of claim 1, wherein the latching mechanism at the over-mold portion is capable of being latched to the recess when the first connector is selectively coupled to the third connector.

3. The multi-platform I/O connector plug of claim 1, wherein the latching mechanism comprises one or more of:

magnets at the over-mold portion and at the recess; and mechanical latching mechanisms at the over-mold portion and at the recess.

4. The multi-platform I/O connector plug of claim 1, further comprising a latching mechanism at the first connector and the second connector when the first connector is selectively coupled to the second connector.

5. The multi-platform I/O connector plug of claim 4, wherein the latching mechanism comprises mechanical latching mechanisms at the first connector and at the second connector.

6. The multi-platform I/O connector plug of claim 1, wherein the latching mechanism at the over-mold portion is capable of coupling to a platform housing when the first connector is selectively coupled to the second connector of the small form factor computing device.

7. The multi-platform I/O connector plug of claim 6, wherein the latching mechanism comprises magnets at the over-mold portion and at the platform housing of the small form factor computing device.

8. The multi-platform I/O connector plug of claim 1, wherein the over-mold portion and the recess are to enable alignment of the first connector with the third connector of the large form factor computing device.

9. The multi-platform I/O connector plug of claim 1, wherein the over-mold portion is to support the first connector coupled with the third connector from a force received at the over-mold portion.

10. An I/O receptacle comprising:

a recess to receive an over-mold portion of a multi-platform plug, the recess comprising four sides to provide vertical retention and lateral retention support to a connector to be received in the recess; and a first connector disposed within the recess, the first connector to receive a second connector protruding from the over-mold portion of the multi-platform plug; and a latching mechanism at the recess configured to receive the over-mold portion.

11. The I/O receptacle of claim 10, wherein the latching mechanism comprises one or more of:

magnets at the over-mold portion and at the recess; and mechanical latching mechanisms at the over-mold portion and at the recess.

12. The I/O receptacle of claim 10, wherein the over-mold portion and the recess are to enable alignment of the first connector and the second connector.

13. The I/O receptacle of claim 10, wherein the over-mold portion is to support receiving the first connector at the second connector from a force received at the over-mold portion.

14. A connector assembly comprising:

a plug comprising an over-mold portion, a first connector portion protruding from the over-mold portion;

a receptacle to selectively receive the first connector portion of the plug at one of a second connector of a small form factor computing device and a third connector of a large form factor computing device;

wherein, when the first connector of the plug is received at the third connector of the receptacle, the over-mold portion is inserted into a recess of the large form factor computing device which surrounds the third connector, the recess comprising four sides to provide vertical retention and lateral retention support to a connector to be received in the recess; and a latching mechanism at the over-mold portion.

15. The connector assembly of claim 14, further comprising a latching mechanism at the recess to engage with the latching mechanism at the over-mold portion when the first connector of the plug is selectively received at the third connector of the receptacle.

16. The connector assembly of claim 15, wherein the latching mechanisms comprises one or more of:

magnets at the over-mold portion and at the recess; and mechanical latching mechanisms at the over-mold portion and at the recess.

17. The connector assembly of claim 14, further comprising a latching mechanism at the first connector and the second connector when the first connector of the plug is selectively received at the second connector of the receptacle.

18. The connector assembly of claim 17, wherein the latching mechanism comprises mechanical latching mechanisms at the first connector and at the second connector.

19. The connector assembly of claim 14, wherein the latching mechanism at the over-mold portion is to be coupled to a platform housing when the first connector is selectively received at the second connector.

20. The connector assembly of claim 19, wherein the latching mechanism comprises magnets at the over-mold portion to engage with magnets at the platform housing.

21. The connector assembly of claim 14, wherein the over-mold portion and the recess are to enable alignment of the first connector with the third connector.

22. The connector assembly of claim 14, wherein the over-mold portion is to support the first connector received at the third connector from a force received at the over-mold portion.

23. A method, comprising:

selectively receiving a plug comprising an over-mold portion and a first connector portion protruding from the over-mold portion at a receptacle; wherein selectively receiving comprises one of:

receiving the first connector portion of the plug at a second connector of a small form factor computing device;

receiving the first connector portion of the plug at a third connector of a large form factor computing device; and receiving at least a portion of the over-mold portion into a recess of the large form factor computing device which surrounds the third connector;

wherein, when the first connector of the plug is received at the third connector of the receptacle, the over-mold portion is inserted into a recess of the large form factor computing device which surrounds third connector, the recess comprising four sides to provide vertical retention and lateral retention support to a connector to be received in the recess; and latching the plug to the receptacle via the over-mold portion.

24. The method of claim 23,wherein latching the plug to the receptacle comprises latching, via a latching mechanism at the over-mold portion of the plug and the recess, the plug to the receptacle when the first connector of the plug is selectively received at the third connector of the receptacle.

25. The method of claim 24, wherein the latching mechanism comprises one or more of:

magnets at the over-mold portion and at the recess; and mechanical latching mechanisms at the over-mold portion and at the recess.

26. The method of claim 23, wherein latching the plug to the receptacle comprises latching, via a latching mechanism at the first connector and the second connector, the plug to the receptacle when the first connector of the plug is selectively received at the second connector of the receptacle.

27. The method of claim 26, wherein the latching mechanism comprises mechanical latching mechanisms at the first connector and at the second connector.

28. The method of claim 23, wherein latching the plug to the receptacle comprises latching, via a latching mechanism at the over-mold portion and a platform housing, the plug to the receptacle when the first connector is selectively received at the second connector.

29. The method of claim 28, wherein the latching mechanism comprises magnets at the over-mold portion and at the platform housing.

30. The method of claim 23, further comprising aligning, via the over-mold portion and the recess, the first connector with the third connector.

31. The method of claim 23, further comprising supporting, via the over-mold portion, the first connector received at the third connector from a force received at the over-mold portion.

32. An apparatus, comprising:

an input/output (I/O) connector plug including but not limited to:

an over-mold portion; and a first connector portion protruding from the over-mold portion, the first connector portion to carry electrical signals and to be based on a standard interface selected from a group consisting of a universal serial bus (USB), High-Definition Multimedia Interface (HDMI), and Displayport, and wherein the I/O connector plug is capable to be separately inserted into a small form factor connector of a phone device and a large form factor connector of a large form factor device to provide electrical connection to the electrical signals, wherein the I/O connector plug to be inserted into the small form factor connector comprises only the first connector portion to be inserted into the small form factor connector and the I/O connector plug to be inserted into the large form factor connector comprises the first connector portion and at least a portion of the over-mold-portion to be inserted into the large form factor connector.

33. The apparatus of claim 32, further comprising a latching mechanism at the over-mold portion to be received at the large form factor connector.

34. The apparatus of claim 33, wherein the latching mechanism comprises one or more of:

magnets at the over-mold portion; and mechanical latching mechanisms at the over-mold portion.

35. The apparatus of claim 32, further comprising a latching mechanism at the first connector portion protruding from the over-mold portion.

36. The apparatus of claim 35, wherein the latching mechanism comprises mechanical latching mechanisms at the first connector.

37. The apparatus of claim 32, further comprising a latching mechanism at the over-mold portion and a platform housing when the I/O connector is selectively coupled to the small form factor of a phone device.

38. The apparatus of claim 37, wherein the latching mechanism comprises magnets at the over-mold portion and at the platform housing.

39. The apparatus of claim 32, wherein the over-mold portion and the recess are to generate alignment of the first connector with the large form factor connector.

40. The apparatus of claim 32, wherein the over-mold portion is to support the first connector coupled with the large form factor connector from a force received at the over-mold portion.

* * * * *